United States Patent [19]

Rossini

[11] Patent Number: 4,890,764

[45] Date of Patent: Jan. 2, 1990

[54] STATIONARY OR MOBILE CONTAINER FOR CONTAINING OR SHIPPING SUBSTANCES THAT ARE TOXIC, DANGEROUS, CONTAMINATED OR, IN ANY CASE, HARMFUL TO HEALTH AND THE ENVIRONMENT

[76] Inventor: Alberto Rossini, Casa Stella, 6951 Insone, Switzerland

[21] Appl. No.: 323,335

[22] Filed: Mar. 14, 1989

[30] Foreign Application Priority Data

Apr. 11, 1988 [CH] Switzerland ..... 1317/88

[51] Int. Cl.[4] ..... B65D 90/32

[52] U.S. Cl. ..... 220/460; 137/571; 206/524.2; 220/1 B; 220/85 A; 220/85 B; 220/85 S

[58] Field of Search ..... 137/571; 220/1 B, 5 A, 220/5 R, 85 A, 85 B, 85 S, 20.5, 203, 454, 456, 460, 461; 260/524.2

[56] References Cited

U.S. PATENT DOCUMENTS

| | | | |
|---|---|---|---|
| 2,446,811 | 8/1948 | Crawford | 220/456 |
| 3,610,220 | 10/1971 | Yamada et al. | 137/571 |
| 3,664,904 | 5/1972 | Cook | 220/454 |
| 4,723,573 | 2/1988 | Burnett | 137/571 |

FOREIGN PATENT DOCUMENTS

| | | | |
|---|---|---|---|
| 1000095 | 2/1988 | Belgium . | |
| 0071373 | 2/1983 | European Pat. Off. . | |
| 0111356 | 6/1984 | European Pat. Off. . | |
| 3600044 | 10/1987 | Fed. Rep. of Germany . | |
| 2239110 | 2/1975 | France | 220/85 A |
| 2034006 | 5/1980 | United Kingdom | 137/571 |
| 2189002 | 10/1987 | United Kingdom . | |

*Primary Examiner*—Jimmy G. Foster
*Attorney, Agent, or Firm*—Young & Thompson

[57] ABSTRACT

The stationary or mobile container makes possible containing or shipping of solid, liquid, powdery, granular or gaseous substances and in particular that are toxic, dangerous, polluted or, in any case, harmful to health and the environment. It comprises an outside wall (1), for example of metal, a protective inside wall in one or more layers (2, 3), unattackable or in any case inert with respect to the substances contained in it, self-sealing in case of perforation or tearing of outside wall (1) and elastically deformable to compensate for the change in volume caused by deformations of the container in case of impact so that the inside pressure remains almost constant and, an optional expanding additional container (4) connected by a check valve (5) to protective inside wall (2, 3).

7 Claims, 1 Drawing Sheet

STATIONARY OR MOBILE CONTAINER FOR CONTAINING OR SHIPPING SUBSTANCES THAT ARE TOXIC, DANGEROUS, CONTAMINATED OR, IN ANY CASE, HARMFUL TO HEALTH AND THE ENVIRONMENT

This invention has as its object a stationary or mobile container for containing or shipping of solid, liquid, powdery, granular or gaseous substances and in particular that are toxic, dangerous, polluted or in any case harmful to health and the environment.

Containers are now in use which, in case of accidental impact or tearing, do not offer any protection from escaping of the substances contained in them, causing serious and at times irreparable damage to the environment, and seriously endangering the health of the inhabitants of the surrounding areas.

It does not appear to the applicant that said containers exhibit arrangements to block or impede the escape of the substances contained in them in case of their tearing or deformation.

This invention solves this problem in that the container is characterized by a mechanically resistant outside wall of any shape, size and material, by a protective inside wall in one or more layers, unattackable or, in any case, inert with respect to the substances contained in it, nonconducting, self-sealing in case of perforation or tearing of the outside wall and elastically deformable to compensate for the change in volume caused by deformations of the outside wall in case of impact so that the inside pressure remains almost constant and, for the same purpose, by an optional expanding additional container connected by a check valve to the protective inside wall.

The accompanying drawings represent some preferred nonlimiting and nonbinding embodiments of the invention.

Figure 1:
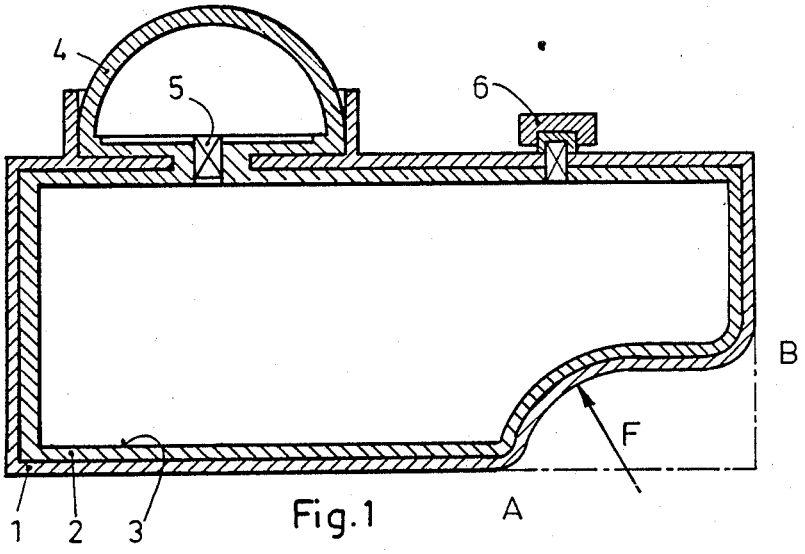
FIG. 1 represents the longitudinal section of a container according to the invention, in the shape of a stationary or mobile tank.

With respect to FIG. 1: the stationary or mobile container comprises outside wall 1, of sheet metal, synthetic resins or other material and protective inside wall 2, 3 unattackable or in any case chemically or physically inert with respect to the substances contained in the tank, for example consisting of an elastic synthetic resin formed by one or more layers 2, 3. Said layers are such that in case of perforation or tearing, for example by a pointed or tearing object 7 (FIG. 2), they do not allow the escape of the contents of the tank since the perforation or tear is automatically healed by the effect of the elasticity of the material of said covering 2, 3 and by the inside pressure.

By application of another layer (not shown) of spongy or absorbent material on the inside of the container, in case it contains liquid substances, possible small lost residues of liquid through the tear or perforation of the self-sealing layer are prevented by the effect of absorption of the percolating liquid by said spongy layer, whose thickness can vary according to needs.

In FIG. 1 the volume of contents of the tank, compressed by deformation AB of outside wall 1, under the action of an impact (force F), has the possibility of being transferred, through escape valve (5) (FIG. 3), suitably calibrated, to expanding additional container 4 by check valve 5 so that it, being expanded, balances the pressure.

The filling cap of the tank is indicated by 6.

Figure 2:
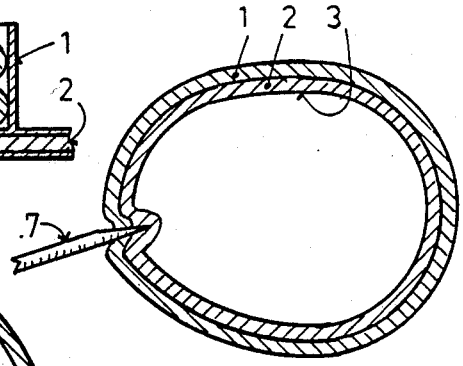
FIG. 2 represents its cross section in case of perforation of the outside and inside wall.

FIG. 2 represents the deformation of outside wall 1 and protective inside wall 2, 3 by a pointed body 7. Removal of said body does not cause any loss of the contents of the tank because protective inside wall 2, 3 is healed automatically.

Figure 3:
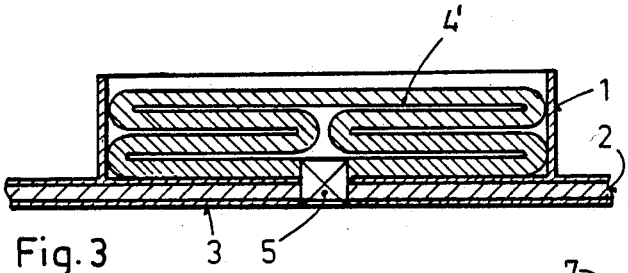
FIG. 3 represents the partial longitudinal section of a variant in the shape of an expanding additional container.

FIG. 3 represents a variant in the shape of expanding additional container 4' which in this case folds.

Figure 4:
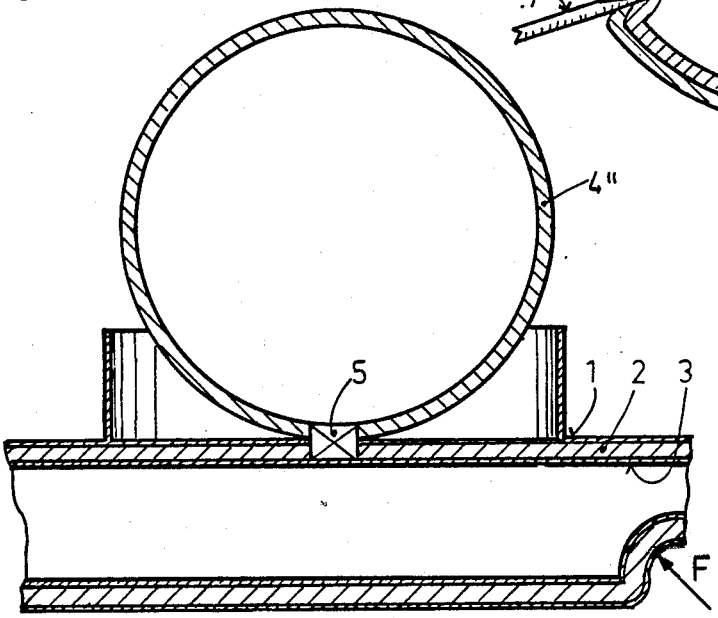
FIG. 4 represents the partial longitudinal section of another variant in the shape of an expanding additional container.

In FIG. 4 expanding additional container 4'' is spherical. The possible embodiments both of protective inside wall 2, 3 of the container and expanding additional container 4, 4', 4'' are most varied and all are understood to come under the scope of protection of the patent.

It is provided that the container in question can be applied to any type of tank or container, great or small, of any material and any shape, mobile or stationary, and that the substances contained can be at any admissible temperature.

Other variants are possible with respect to what has been illustrated, compatible with what is claimed and all is understood as coming within the scope of protection of the patent.

I claim:

1. Stationary or mobile container for containing or shipping of solid, liquid, powdery, granular or gaseous substances and in particular that are toxic, dangerous, polluted or in any case harmful to health and the environment characterized by a mechanically resistant outside wall (1) of any shape, size and material, by an protective inside wall in one or more layers (2, 3), unattackable or, in any case, inert with respect to the substances contained in it, nonconducting, self-sealing in case of perforation or tearing of outside wall (1) and elastically deformable to compensate for the change in volume caused by deformations of outside wall (1) in case of impact so that the inside pressure remains almost constant and, for the same purpose, characterized by an optional expanding additional container (4, 4', 4'') connected by a check valve (5) to protective inside wall (2, 3).

2. Container according to claim 1, wherein said protective inside wall consists of one or more layers (2, 3) able to prevent escape or losses of the contents of the container and to absorb the infiltrations or small losses of liquid substances that may occur through a possible residual section of the opening of the tear in the self-sealing layer even after self-sealing, in this way totally preventing the escape of the liquid to the outside of the container.

3. Container according to claim 2, wherein said protective inside wall (2, 3) consists of one or more spongy, absorbent, self-sealing layers.

4. Container according to claim 1, wherein said protective inside wall (2, 3) does not adhere or adheres only partly to outside wall (1) of the container to allow the elastic deformation of said protective inside wall (2, 3) inside outside wall (1).

5. Container according to claim 1, wherein in case of impact, the excess pressure is balanced by transferring the part of the container due to the deformation into outside expanding additional container (4, 4', 4'') through a check valve (5); said additional container being made of a material that can be elastically expanded.

6. Container according to claim 5, wherein said outside expanding container (4', FIG. 3) is made to fold.

7. Container according to claim 5, wherein said outside expanding container (4'', FIG. 4) expands in spherical shape.

* * * * *